United States Patent [19]

Torborg

[11] 4,373,897

[45] Feb. 15, 1983

[54] OPEN DRAFT HOOD FURNACE CONTROL USING INDUCED DRAFT BLOWER AND EXHAUST STACK FLOW RATE SENSING

[75] Inventor: Ralph H. Torborg, Minnetonka, Minn.

[73] Assignee: Honeywell Inc., Minneapolis, Minn.

[21] Appl. No.: 187,040

[22] Filed: Sep. 15, 1980

[51] Int. Cl.[3] ..... F23N 3/00

[52] U.S. Cl. ..... 431/20; 236/15 C

[58] Field of Search ..... 431/20; 236/15 C

[56] References Cited

U.S. PATENT DOCUMENTS

| | | | |
|---|---|---|---|
| 961,145 | 6/1910 | Mack . | |
| 1,743,731 | 1/1930 | Scott . | |
| 1,773,585 | 8/1930 | Klockau . | |
| 2,061,587 | 11/1936 | Morris . | |
| 2,155,642 | 4/1939 | Dewey . | |
| 2,160,968 | 6/1939 | Hagen . | |
| 2,262,252 | 11/1941 | Roland . | |
| 2,537,082 | 1/1951 | Palmer . | |
| 2,619,326 | 11/1952 | McLenegan . | |
| 2,691,413 | 10/1954 | Leslie et al. . | |
| 2,698,140 | 12/1954 | Boehler . | |
| 2,913,044 | 11/1959 | Mobley . | |
| 2,956,132 | 10/1960 | Hilgert | 431/20 |
| 3,042,769 | 7/1962 | Campbell . | |
| 3,106,175 | 10/1963 | Anderson . | |
| 3,294,146 | 12/1966 | Voorheis . | |
| 3,489,345 | 1/1970 | Moreland . | |
| 3,650,262 | 3/1972 | Root et al. | 431/20 |
| 3,768,956 | 10/1973 | Mueller et al. | 431/20 |
| 4,102,627 | 7/1978 | Reed et al. | 431/16 |
| 4,251,025 | 2/1981 | Bonne et al. | 236/14 |

*Primary Examiner*—Carroll B. Dority, Jr.

*Attorney, Agent, or Firm*—Clyde C. Blinn; Stuart R. Hemphill

[57] ABSTRACT

Apparatus is provided for modifying an open draft hood furnace and its control system, to produce an induced draft furnace having increased efficiency. A blower located in the furnace exhaust stack is used to induce movement of air and combustion products into and through the draft hood. A flow-limiting orifice located in the exhaust stack upstream from the blower causes a region of reduced pressure to exist downstream from the orifice. A pressure signal representative of the flow rate of exhaust stack gases is sensed on the downstream side of the orifice and is communicated by a conduit to a pressure switch connected to a gas valve, which together control gas to the burner. No gas is permitted to flow to the burner unless a predetermined reduced pressure level is achieved at the downstream side of the orifice. A small opening in the conduit permits a small flow of flushing air to enter the conduit.

11 Claims, 3 Drawing Figures

OPEN DRAFT HOOD FURNACE CONTROL USING INDUCED DRAFT BLOWER AND EXHAUST STACK FLOW RATE SENSING

BACKGROUND OF THE INVENTION

1. Field of the Invention

This invention relates to combustion heating systems and control apparatus for such systems. More specifically, this invention relates to apparatus for modifying an open draft hood furnace and its control system, to produce an induced draft furnace having increased efficiency.

2. Description of the Prior Art

Conventional gas-fired, natural draft furnace systems typically operate at a steady-state efficiency of about 75%. The seasonal average efficiency of such furnace systems is usually considerably lower, on the order of 60%. As the cost of gas and other fuels used for heating rises, and as such fuels grow scarcer, these levels of efficiency are considered less and less acceptable, and various ways of increasing furnace system efficiency are sought.

Several methods of increasing furnace efficiency are known in the prior art. For example, it is known that significant efficiency-reducing losses occur due to the escape of heat up the flue, vent, or exhaust stack during the portion of the furnace cycle when the burner is off. This heat is primarily heat taken from the burner heat exchanger following a burning cycle. One prior art solution to this form of heat loss is to provide dampers of various kinds which permit draft flow when required for the burning cycle, but serve to limit draft flow when the burner is not on. Examples of such dampers may be seen in the following U.S. Pat. Nos. 1,743,731; 1,773,585; 2,011,759; 2,218,930; 2,296,410; 4,017,027 and 4,108,369. As these patents show, a damper having the desired effect can be placed so as to limit exhaust draft flow out of the combustion chamber or input air flow into the combustion chamber.

A second form of efficiency-reducing loss in furnaces occurs due to inefficient burning as a result of improper air-fuel ratio. The prior art shows several methods for controlling fuel and/or air flow in order to maintain the air-fuel ratio as close as possible to the chemical ideal of stoichiometric burning, in which all fuel and oxygen would be completely combusted. Such prior art arrangements include U.S. Pat. No. 3,280,744, which shows an orifice plate of pre-selected cross-section and draft-limiting characteristics combined with a draft blower fan, and U.S. Pat. No. 2,296,410, which shows an apparatus for mechanically linking a modulating fuel regulator to a draft damper, to regulate the air supply in relation to the fuel supply.

A third form of efficiency-reducing loss which occurs in open draft hood furnaces is due to air dilution via the draft hood during the burning cycle. Because the air which flows through the draft hood is often equal in volume to the exhaust gas flow from the combustion chamber and because the draft hood air is normally taken from a heated space surrounding the furnace, a substantial energy loss may occur.

SUMMARY OF THE INVENTION

The present invention provides apparatus for modifying a combustion apparatus with an open draft hood and its associated control system, to produce an induced draft furnace having increased efficiency. With the present invention, a blower located in the exhaust stack or vent is used to induce the movement of air and combustion products into and through the open draft hood, while the natural draft flows through the combustion chamber remain relatively unaffected. A flow-restricting orifice means in the exhaust stack upstream from the blower causes a region of lower pressure to exist downstream from the orifice, as compared to the (approximately) atmospheric pressure which exists upstream from the orifice. A pressure signal representative of the exhaust stack flow rate through the orifice is sensed on the downstream side of the orifice and is communicated to a fuel supply control means, including a pressure switch and a gas valve, which together permit outlet gas flow from the valve only when the magnitude of the exhaust stack flow rate exceeds a predetermined value. A conduit connected between the exhaust stack and the pressure switch senses and communicates the pressure signal representative of exhaust gas flow rate. In the conduit used to communicate the sensed stack pressure to the pressure switch, means for flushing the conduit to reduce the possibility of condensation, corrosion or blockage are provided.

The principal objects of the present invention are to provide an improved open draft hood furnace or heating apparatus design and control system which: (a) provides improved steady-state and seasonal efficiency as compared to conventional natural draft furnaces; (b) utilizes an induced draft blower and a stack flow rate control signal to control burner fuel flow responsive to the exhaust gas flow rate; (c) utilizes exhaust gas pressure as a means of determining stack flow rate and as a control signal; (d) provides a means for limiting draft hood air dilution for increased efficiency; (e) provides means for flushing combustion gases from passages forming a part of the furnace control system; (f) provides safety features to shut off fuel gas when the exhaust stack is blocked; and (g) reduces off-cycle energy losses by limiting stack flow by means of a small stack orifice and an induced-draft blower located in the stack flow path.

BRIEF DESCRIPTION OF THE DRAWINGS

In the accompanying drawings forming a material part of this disclosure.

DESCRIPTION OF THE INVENTION

Figure 1:
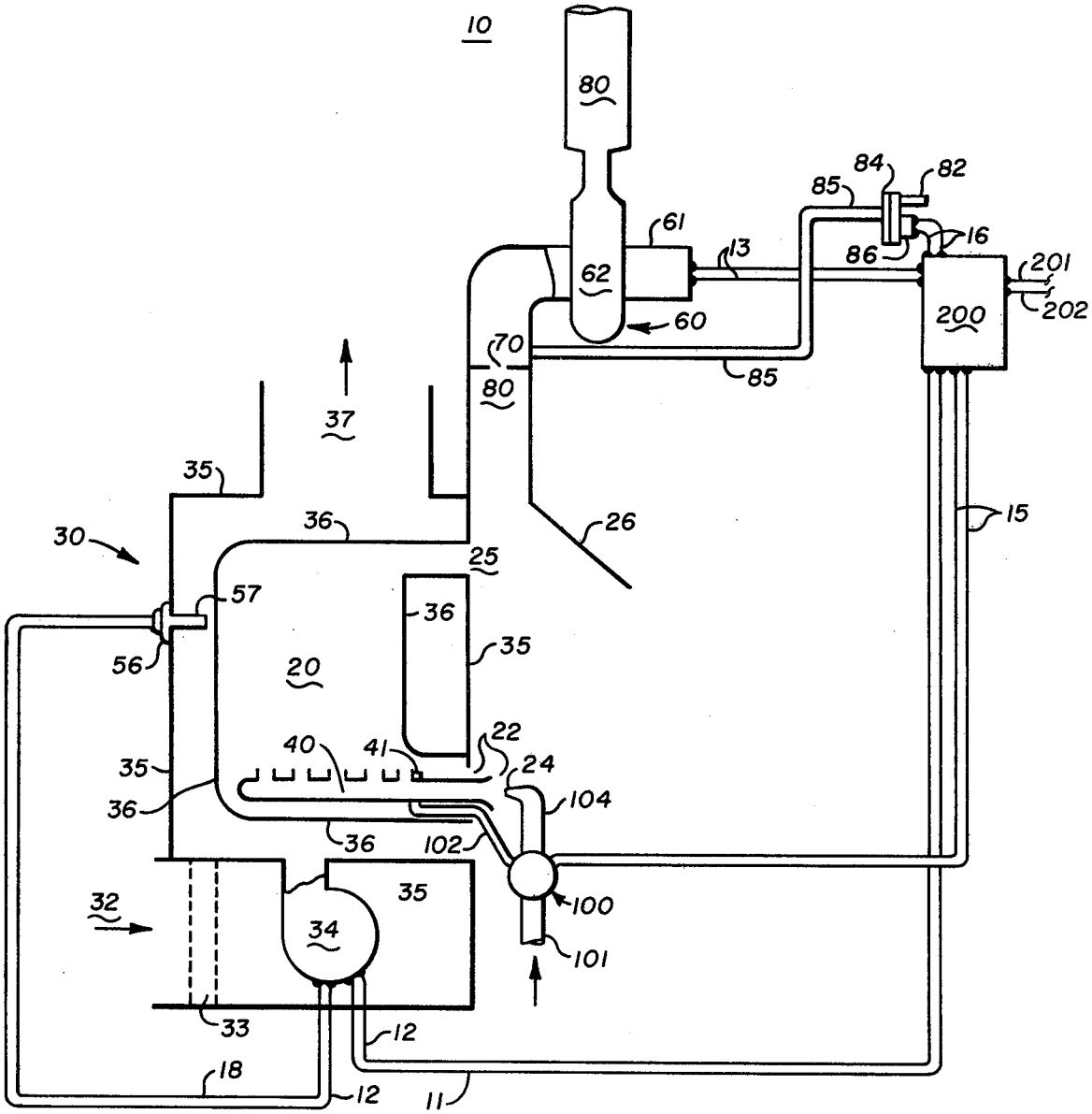
FIG. 1 is a schematic drawing of the open draft hood furnace and control system of the present invention, using a flow-limiting orifice upstream from an induced draft blower.

Description of Preferred Embodiment a. General Configuration of Furnace and Control System An open draft hood furnace and furnace control system 10 in accordance with the present invention consists generally, as shown in FIG. 1, of one or more combustion chambers 20, each of which has a burner 40 located near its bottom. Each combustion chamber 20 is substantially enclosed by exterior walls 36 except for a flue and draft hood opening 25 near its top. Fuel, which in the preferred embodiment is a gas such as natural gas or liquified petroleum, is fed to the burner 40 by a gas outlet 24 near the mouth of the burner 40. Air enters the burner 40 and the combustion chamber 20 at air inlets 22, located near the tip of the gas outlet 24 and the mouth of the burner 40. A pilot frame 41 positioned immediately adjacent the burner 40 is used to ignite it.

Surrounding the combustion chamber (or chambers) 20 is heat exchanger 30 with its exterior boundary being formed by the exterior walls 36 of the combustion chamber 20 and its exterior boundary being formed by the walls 35. Thus two separate fluid paths are formed. The combustion chamber path leads from the gas outlet 24 and air inlets 22 through the burner 40, to the flue and draft hood opening 25 and out the stack 80. The heat exchanger path follows the exterior walls 36 of the combustion chamber 20, with the fluid to be heated entering below the burner 40, proceeding along the vertical portion of the enclosed area between the walls 35 and the exterior burner wall 36 to exit above the combustion chamber 20. While in the preferred embodiment air is the fluid to be heated, other fluids, such as water, may also be used with minor design changes.

Figure 3:
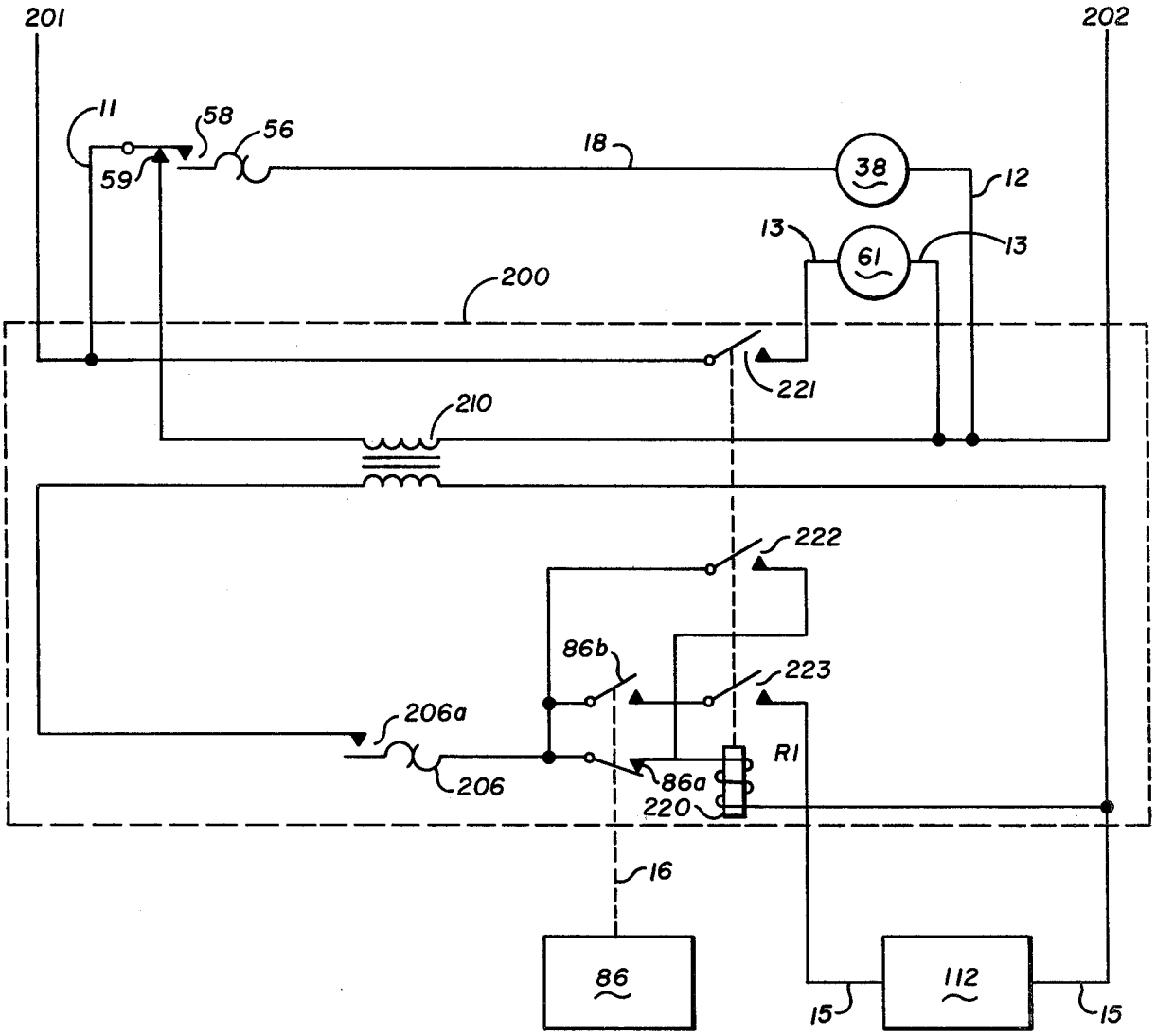
FIG. 3 is an electrical schematic of a thermostatic control system used in connection with the present invention.

As is conventional, movement of air into and through the heat exchanger 30 is provided by a fan 34 driven by an electric motor 38 (FIG. 3; not shown in FIG. 1). Cold air is pulled into the heat exchanger 30 at a cold air return duct 32 and passes through an air filter 33 before it enters the fan 34. The fan 34 drives the air into the heat exchanger 30 through an opening in its bottom wall. Heated air passes out of the heat exchanger 30 through a warm air duct 37, which extends from an opening in the top wall of the heat exchanger 30.

With the flue and draft hood opening 25, the open draft hood 26 and the combustion air inlets 22 adjacent the gas outlet 24, the combustion chamber 20 has the configuration of a conventional open draft-hood furnace. The exit for combustion materials is provided by the flue and draft hood opening 25 leading to the exhaust stack 80. Air which is induced to enter the draft hood 26 because of the flow of combustion materials through the opening 25 and up the stack 80 dilutes the combustion materials. In a conventional natural draft furnace, the amount of air dilution depends on the amount of natural draft suction formed across the open draft hood 26 by the exiting combustion materials. Such air dilution is generally greater than 100%. In the present invention, however, the natural draft path is modified by a draft blower 60 and a flow-limiting restriction, preferably a stack orifice 70, which appear in the exhaust gas path. The stack orifice 70 is, in the preferred embodiment, an orifice plate having an opening one and one-half to two inches in diameter, as compared with a typical stack inside diameter of five inches or more; a flow nozzle or venturi tube of appropriate dimensions could also be substituted for an orifice plate. Both the orifice 70 and the blower 60, when not operating, serve to significantly limit the natural draft flow up the stack 80. With the present invention, the blower 60, in combination with the orifice 70, is also used to control exhaust gas flow during the burning cycle when the blower 60 is on.

Figure 2:
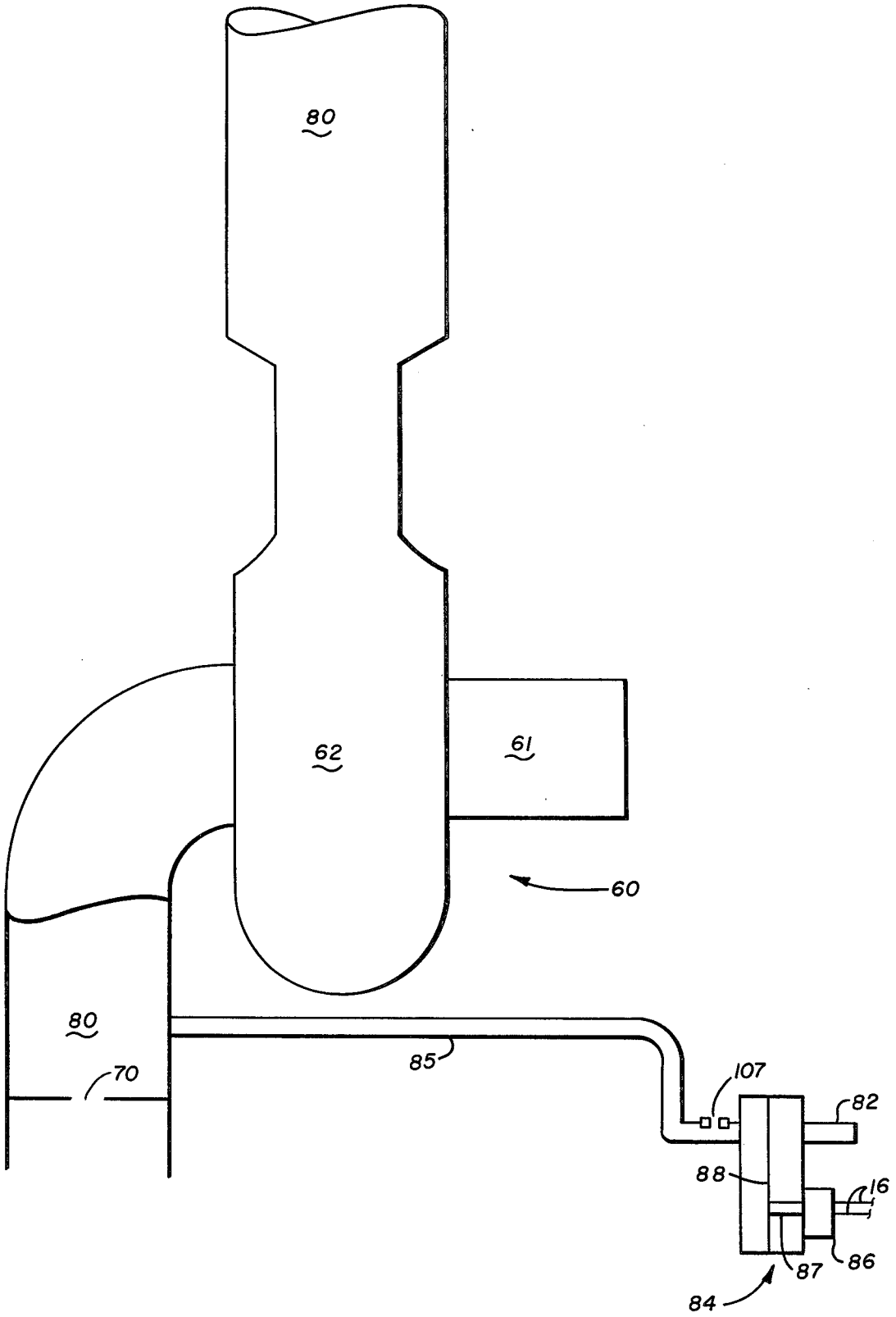
FIG. 2 is a detail of the induced draft blower, exhaust stack and pressure-sensing components of the invention shown in FIG. 1.

In order to induce air to enter the combustion chamber 20 at the combustion air inlets 22 and to induce combusted gases to exit from the combustion chamber 20 and flow out the opening 25 and exhaust stack or vent 80 during a burning cycle, the induced draft blower 60 is used. As seen in FIGS. 1 and 2, the blower 60, with its electric motor 61 and fan blades 62, is located in line with the opening 25 and the exhaust stack or vent 80, downstream from the draft hood 26. Electric power is supplied to the motor 61 by a line voltage source, indicated by wires 13. The blower 60 may be single or multiple speed, depending on the type of control system with which it is to be used. While blowers of various specifications may be used, in the preferred embodiment the blower 60 is single-speed, is powered by 120 volts a.c. and produces approximately 0.35 inch W.C. suction pressure (relative to atmosphere) at 450 degrees Fahrenheit, at a flow rate of about 40 c.f.m. Thus, the blower 60 is selected to be compatible with exhaust gases at elevated temperatures and to operate at low pressures achievable with low cost components, e.g., 0.3–0.5 inch W.C.

The fluid fuel (preferably natural gas or liquified petroleum) is provided to the burner 40 at the gas outlet 24, fed by the outlet pipe 104 of a gas valve 100, which serves as one element of a fuel supply control means. Gas from a supply maintained at line pressure enters the gas valve 100 at a gas inlet pipe 101. Gas regulated to a desired, predetermined outlet pressure flows out of the gas valve 100 through the outlet pipe 104. The pilot flame 41 is supplied with gas at line pressure by a smaller outlet pipe 102, also from the gas valve 100. The structure and operation of the gas valve 100 which permits it to deliver gas in the desired manner is discussed below.

FIG. 1 also shows in a general, schematic manner, the interconnections between the various components forming the furnace control system. Coordination of the control system is provided by a thermostatic control 200 which includes various temperature-sensitive components and switching elements, as will be described in greater detail below in connection with FIG. 3. These components and switching elements serve as the means for controlling operation of the blower 60 and for enabling the gas valve 100. Power to the thermostatic control 200 is provided by connections to a line voltage source, indicated by wires 201, 202.

The thermostatic control 200 is electrically connected, via wires 16, to a differential pressure switch 86, which is actuated by a differential pressure sensor 84. Referring now also to FIG. 2, one input to the differential pressure sensor 84 is provided by a conduit 85 which connects one side of the differential pressure sensor 84 to a pressure region in the exhaust stack 80. In the embodiment shown in FIG. 1, this region is located upstream from the induced draft blower 60 and downstream from the stack orifice 70, which is also located upstream of the blower 60. The pressure in this region near the orifice 70 will hereinafter be referred to as the "stack pressure" or "exhaust pressure." The second input to the differential pressure sensor 84 is provided by a conduit 82 which communicates with the other side of the differential pressure sensor 84. The pressure in conduit 82 is derived from the furnace system's ambient atmosphere. This pressure is approximately equal to the pressure in the draft hood 26, upstream from the orifice 70, and will hereinafter be referred to as the "atmospheric reference pressure."

Referring now to FIG. 2, as is conventional in such pressure sensors, the pressure differential, which corresponds to the pressure difference across the orifice 70 and, thus, is indicative of mass flow of exhaust gas in the exhaust stack 80, affects the position of a diaphragm 88 which, in turn, through an actuator rod 87, causes the switch 86 to change state when a predetermined pressure differential (e.g., 0.30 inches, plus or minus 0.05 inches W.C., in the preferred embodiment) exists. This change of state in the switch 86 causes one circuit path to be opened while another is simultaneously closed. (Due to inherent hysteresis, the switch 86 will actually change state at two slightly different predetermined values, depending on whether the pressure differential is increasing or decreasing.) It will be seen that when the blower 60 is in operation, the pressure communicated by the conduit 85 will be less than atmospheric (negative or suction pressure).

The thermostatic control 200 is also electrically connected to the motor 61 of the stack blower 60 via wires 13. As is described in greater detail below, it is this connection which permits the thermostatic control 200 to turn the blower motor 61 on and off. The thermostatic control 200 is further electrically connected to the gas valve 100, via wires 15. It is this connection which permits the thermostatic control 200 to ensure that gas is available from the gas valve 100 to the gas outlet pipe 104 and the pilot outlet pipe 102 only when desired.

The fan 34 which circulates air through the heat exchanger 30 is provided with power by line voltage connections 11 and 12. The fan motor 38 (FIG. 3; not shown in FIG. 1) is electrically connected, via wires 12 and 18, to a fan/limit control switch 56 which is driven by a temperature sensitive element 57, such as a bimetal thermostat. This temperature sensitive element 57 causes the fan motor 38 to be switched on when the air temperature in the heat exchanger 30 rises above a predetermined temperature (fan-start setpoint) and to be switched off when the temperature of the air in the heat exchanger 30 sinks below a predetermined temperature (fan-stop setpoint). One suitable temperature sensitive switch for this purpose is the L4064 fan and limit switch manufactured by Honeywell Inc., of Minneapolis, Minn. Because one purpose of the fan/limit control switch 56 is to delay fan start-up until the heat exchanger 30 contains air at or above a predetermined temperature, a time-delay mechanism could be substituted for the temperature sensitive element 57. This mechanism could be activated at the same time as the blower motor 61, but it would delay fan start-up for a predetermined period sufficient to let the heat exchanger 30 reach the predetermined temperature.

A potential problem in sensing pressure in hot exhaust gas is the possibility of condensing water in the conduit 85 to the pressure sensor 84. Exhaust gas from natural gas combustion, for example, contains about 10% water vapor. An additional feature of the invention which is shown in FIGS. 1 and 2 is a means used to flush out the pressure communicating conduit 85. Because less-than-atmospheric pressure exists in the conduit 85 when the draft blower 60 is operating, the introduction of a relatively small leak orifice, e.g. a small tap hole 107 the size of a No. 80 drill, into the conduit 85 causes a small flow of ambient air to enter the conduit 85 and flow towards the stack 80. This reduces or eliminates the diffusion of combustion materials from the stack 80 into the conduit 85 and the associated pressure sensor 84, without significantly affecting the stack pressure communicated.

b. Gas Valve

Schematically shown in FIG. 1 is the gas valve 100, including its connections to various other parts of the furnace system. In the preferred embodiment, this valve is a redundant valve, such as the Model VR 844 valve manufactured by Honeywell Inc. As this valve is conventional and known to those skilled in the art, it will not be described in great detail herein; only its salient features for purposes of this invention will be discussed. As mentioned, the VR 844 valve is a redundant valve, meaning that it has several shut-off points. In addition, it operates with an intermittent pilot, as required now in many areas of the country. This type of valve is activated by means of a solenoid actuator 112 (not shown in FIG. 1; see FIG. 3) and an automatic ignition system (also not shown). When the solenoid actuator 112 is activated, gas is permitted to flow to the pilot 41, but no gas is available from the outlet 24. When the automatic ignition lights the pilot 41 an ionization current is established which then serves to trigger opening of the main valve supplying gas to the outlet pipe 104 at a predetermined pressure (less than or equal to line pressure), in the preferred embodiment 3.5 inches W.C. Because the gas valve 100 operates automatically once the solenoid actuator 112 is activated, the only electrical connection required to the valve 100 from the thermostatic control 200 is a pair of wires 15.

c. Control System

Shown in FIG. 3 is an electrical schematic of a one-stage thermostat control system for the present invention. This schematic illustrates the components which would be contained within the thermostatic control 200 and also those electrically connected thereto, such as the electric motors 38, 61, the fan control switch 56 and the differential pressure switch 86. Power in the form of line voltage, e.g. 120 volts a.c., is provided to the control system via wires 201 and 202. This line voltage is also connected to the fan motor 38, via two wires 11, 12 and the normally open main contacts 58 of the fan/limit control switch 56, and to the induced shaft blower motor 61, via the wires 13 and the normally open relay contacts 221. The line voltage is stepped down to an appropriate thermostat voltage, e.g., 24 volts a.c., by a transformer 210.

The secondary voltage from the transformer 210 powers the R1 relay 220, which actuates normally open relay contacts 222 and 223, as well as the previously mentioned relay contacts 221 in series with the blower motor 61. A bimetal-mercury thermostat switch 206 (such as Honeywell Inc. thermostat model T87) which contacts **206*a* is in series with all of the components connected to the secondary side of the transformer 210. Switch contacts 86*a* (normally closed), in series with the coil of the R1 relay 220, and switch contacts 86*b* (normally open), in series with the solenoid actuator 112 for the gas valve 100, are actuated by the differential pressure switch 86. This switch is constructed such that when contacts 86*a* open, contacts 86*b* close, while when contacts 86*b* close, contacts 86*a* open. The solenoid actuator 112 for the gas valve 100 is also connected in series with R1 relay contacts 223. This configuration constitutes a safe start feature, because each startup cycle requires that the differential pressure switch 86 go from its normal state (contacts 86*a* closed, contacts 86*b* open) to its switched state (contacts 86*a* open, contacts 86*b* closed). Should, for example, the contacts 86*a* be welded closed, the R1 relay 220 will be activated, but the actuator 112 will receive no current, because the contacts 86*b*** will be kept open.

An additional element of the one-stage control system is normally closed contacts 59, in series with the primary side of the transformer 210. Contacts 59 are opened by fan/limit control switch 56 at a predetermined temperature (shutdown setpoint), corresponding to a dangerously high heat exchanger temperature.

Operation of the Preferred Embodiment

The operation of the present invention can best be understood in terms of two interrelated sequences of operation. The first sequence of operation concerns the functioning of the gas supply valve 100. This valve is designed to produce an outlet gas pressure regulated to a predetermined pressure, once the valve is enabled by the pressure switch 84.

It should be noted that although the preferred embodiment described herein has a control system which relies on a pressure signal to control the gas supply, this is only one way of approaching the control objective of the invention. Given the flow-restricting geometry of the gas valve 100 and the orifice 70, the exhaust gas flow rates correspond to pressures measured adjacent the orifice 70. In particular, the greater the pressure differential across a flow-restricting orifice of a given size, the greater the flow through the orifice. In fact, flow is proportional to the square root of the pressure difference. For this reason, it is possible to use the relationship between pressures sensed at appropriate locations as a substitute for direct sensing of a flow rate. However, it should be clear that the present control arrangement can be implemented by sensing parameters other than pressure, which also correspond to flow rates, and by using the sensed values to control fuel delivery, although the following discussion of operation specifically discusses a pressure-oriented control system.

a. Operation of Gas Valve

As discussed above, the gas valve 100 is a redundant, intermittent-pilot type valve of the conventional type, such as the Honeywell Inc. Model VR 844. Activation of such a valve occurs in twp steps. First, to turn on the gas to the pilot 41, a solenoid actuator 112 is activated via wires 15. This permits gas to enter the valve 100 as a whole, but the only possible outlet at this point is to the pilot 41. Once pilot gas is flowing, an automatic ignition system (not shown) becomes active. When ignition has occurred, an ionization current exists which triggers the remainder of the operation sequence of the valve 100. In particular, other parts of the redundant valve mechanism open, and gas now also flows from the outlet pipe 104. Because the valve 100 has a servoregulator mechanism, the outlet gas pressure is regulated to an approximately fixed level, in the preferred embodiment 3.5 inches W.C.

Upon shutdown, current to the solenoid actuator 112 is interrupted. This causes all gas flowing through the valve 100 to be interrupted. Both the pilot gas and gas from outlet pipe 104 are cut off.

b. Operation of One-Stage Control System

Referring now to FIG. 3, the second important sequence of operation for the invention, the operation of the electrical components for the one-stage control system, is described.

When the temperature in the heated space whose temperature is to be regulated sinks below the room temperature setpoint of the thermostatic control 200, the bimetal element 206 closes its contacts **206*a* to initiate a burning phase. Assuming that the differential pressure switch 86 is in its normal position, contacts 86*a* will be closed and contacts 86*b* open. The coil of R1 relay 220 will become energized, causing contacts 221, 222 and 223 to close. Thus, the blower motor 61 starts, and pressure begins to decrease in the stack 80 downstream from the orifice 70. When the stack pressure is less than atmospheric reference pressure by a predetermined amount, e.g., in the preferred embodiment, 0.30 inches, plus or minus 0.05 inches W.C., the differential pressure switch 86 changes state, closing contacts 86*b* and opening contacts 86*a*. Blower operation and sufficient combustion air for proper combustion are thus proved. The R1 relay coil 220 remains energized due to the closed contacts 222, and the solenoid 112 of the gas valve 100 is activated. Thus, the previously described operation sequence for the gas valve 100 commences. The pilot frame 41 gets gas and is ignited, causing the remainder of the valve 100 to open. The servoregulator section of the valve 100** begins to regulate the outlet gas pressure to a predetermined pressure level which is adequate for the chosen firing rate of the furnace.

When the burner 40 lights and the temperature in the combustion chamber 20 and the heat exchanger 30 rises, this is detected by the temperature sensor 57 (FIG. 1) of the fan/limit control switch 56. When the fan-start setpoint for this sensor 57 is reached, the fan motor 38 is energized by closing of the main contacts 58. Cold air will be drawn into the heat exchanger 30 and warmed air will be sent to the heated space.

The burning phase will continue until the heated space rises above the room temperature setpoint, causing the bimetal element 206 to open its contacts **206*a*. At this point the R1 relay coil 220 is deenergized, and the contacts 221, 222 and 223 are opened. The solenoid actuator 112 of the gas valve 100 loses power and cuts off the gas supply from the gas valve 100, and the stack blower motor 61 stops running. Because the now stationary blower fan blades 62 and the flow-limiting orifice 70 are in the exhaust flow path of the stack 80 (FIG. 1), they substantially inhibit further draft flow up the stack 80. Thus, the heat stored in the heat exchanger 30 is conserved. The fan motor 38 will continue to run until the bimetal sensor 57 of the fan limit control switch 56 reaches its fan-stop setpoint, causing the main contacts 58** to open.

It will be seen that with the present invention, the blower 60, in combination with the orifice 70, is used to control exhaust gas and dilution air flow during the burning cycle when the blower 60 is on. For example, assuming the blower 60 is capable of producing a stack pressure of −0.35 inches W.C. at approximately 40 c.f.m. flow rate, and further assuming the furnace firing rate is 100,000 BTU/hr. and the excess air level 60% (40%–60% is typical), the combustion product flow rate through the orifice 70 will be approximately 25 c.f.m. By selecting the size of the orifice 70 such that the total flow rate through the blower 60 is approximately 30 c.f.m., combustion product venting is assured and, in addition, a small air dilution, approximately 20%, is provided. This is much less than the draft hood air dilution of conventional natural draft furnaces, which is generally greater than 100% and represents a substantial energy loss.

By reducing this on-cycle energy loss and also controlling off-cycle energy loss, the present invention can be expected to achieve fuel savings greater than those obtained with a stack damper. It is significant that the present invention can accomplish this in an existing furnace on a retrofit basis. No significant mechanical changes in the furnace would be required. The orifice and blower assembly can simply be mounted on the furnace stack outlet. The system could also be used to retrofit an oil burner heating system. In this case, it would be installed downstream of the barometric damper.

Another feature of the present invention is safety shutdown in case of a blocked stack. If at any time during burner operation, the pressure differential sensed by the sensor 84 drops below the predetermined value at which the switch 86 changes state, the R1 relay coil 220 will be deenergized to cut off the gas supply. A blocked stack downstream of the blower 60 will, of course, lead to a decrease in exhaust gas flow rate and a reduction of the sensed pressure differential. A severely blocked stack will, thus, lead to furnace shutdown.

Among the enhancements or variations of the present invention are certain additional safety features. For example, the temperature sensor 57 may include a third, danger-condition, setpoint, at a temperature level higher than its setpoint to turn the fan 34 on and off, and second normally-closed contacts 59, actuated by the sensor 57 and placed in series with the primary side of the transformer 210, as shown in FIG. 3. The danger-condition setpoint is chosen such that an abnormally high heat exchanger temperature can be detected. When such a temperature is detected, the second, normally-closed contacts 59 are opened, cutting power to the primary side of the transformer 210, and the system is shut off. This avoids dangers caused by continued burning with an abnormally high heat-exchanger temperature.

A second additional safety feature which can be incorporated in the present control system is a pressure sensor which detects low outlet gas pressure, a condition which can sometimes lead to abnormal combustion in the burner 40. This low gas pressure sensor would sense pressure in the gas outlet pipe 104, and would only be enabled once a normal burning phase had started, so that it would not interfere with start-up. Activation of the low gas pressure sensor would cause the gas to be shut off and the rest of the system to be shut down normally, by a mechanism similar to that used in the case of stack blockage.

It will be obvious to one skilled in the art that a number of modifications can be made to the above-described preferred embodiment without essentially changing the invention. For example, it is clear that other differential pressure switch designs could be used which perform essentially the same control function. Various solid-state sensors and switching devices may be substituted for the bimetal thermostatic element and the contacts and relays shown. One skilled in the art would also realize that the present invention, while best suited as a design for retrofitting existing open draft hood, natural draft furnaces, it may also be used, as a design for the manufacture of new furnaces. Accordingly, while the preferred embodiment of the invention has been illustrated and described, it is to be understood that the invention is not limited to the precise constructions herein disclosed, and the right is reserved to all changes and modifications coming within the scope of the invention as defined in the appended claims.

Having thus described the invention, what is claimed as new, and desired to be secured by Letters Patent, is:

1. In a heating system having a combustion chamber with a fuel burner located adjacent an air opening, an exhaust stack, and an open draft hood connected to said exhaust stack and in communication with an upper end of the combustion chamber and open to atmospheric air, the improvement comprising:

(a) a blower connected to the exhaust stack for inducing a draft in the exhaust stack and for drawing air into the combustion chamber and into the draft hood;

(b) means adapted to be mounted in the exhaust stack for forming a flow restriction in the exhaust stack upstream from the blower;

(c) fuel supply control means responsive to a control signal representing flow of exhaust gas through the flow restriction to supply fuel to the burner only when such control signal exceeds a predetermined magnitude;

(d) sensor means for sensing a quantity representative of said flow of exhaust gas through the flow restriction and for communicating said quantity as a control signal to said fuel supply control means; and (e) blower control means adapted for connection to the blower for starting and stopping operation of the blower.

2. The heating system as recited in claim 1 wherein said sensor means senses a pressure and comprises conduit means for communicating exhaust stack pressure connected to said exhaust stack downstream from said flow restriction and said heating system further comprises means for introducing a flow of flushing gas into said conduit means to flush out exhaust gas.

3. The heating system as described in claim 2 wherein said fuel burner burns gas and said fuel supply control means supplies gas at a predetermined pressure.

4. The heating system as described in claim 3 wherein said means for forming a flow restriction comprises an orifice plate inside the exhaust stack.

5. The heating system as described in claim 2 wherein said means for introducing a flow of flushing gas comprises a leak orifice in said conduit means.

6. The heating system as described in claim 2 wherein said fuel supply control means comprises:

a fuel valve; and a pressure sensor connected to said conduit means and to an electrical switch, wherein the opening and closing of the switch determines the opening and closing of said fuel valve.

7. The heating system as described in claim 2 where in said fuel supply control means comprises:

a differential pressure (d.p.) sensor with one input being the exhaust stack pressure communicated by said conduit means and the other input being an atmospheric reference pressure;

switch means responsive to the detection of a predetermined pressure differential in said d.p. sensor, the presence or absence of said predetermined pressure differential determining the state of said switch means;

means for communicating the state of said switch means; and gas valve means for supplying gas to said burner, said gas valve being responsive to the state of said switch means to supply gas only when the switch means indicates the presence of a predetermined pressure differential.

8. The heating system as recited in claim 7 wherein said gas valve includes a solenoid actuator connected to said means for communicating the state of said switch.

9. The heating system as recited in claim 2 wherein said blower control means includes thermostat means for sensing the temperature in a space to be heated by said heating system.

10. In a heating system having a combustion chamber with a fuel burner located adjacent an air opening, a fuel valve for supplying fuel to said burner, an exhaust stack, and an open draft hood connected to said exhaust stack and in communication with an upper end of the combustion chamber and open to atmospheric air, the improvement comprising:

(a) a blower connected to the exhaust stack for inducing a draft in the exhaust stack and for drawing air into the combustion chamber and into the draft hood;

(b) means adapted to be mounted in the exhaust stack for forming a flow restriction in the exhaust stack upstream from the blower;

(c) sensor means for sensing a quantity representative of exhaust gas flow rate through the flow restriction and for communicating said quantity as a control signal;

(d) control means communicating with said fuel valve for turning said fuel valve on and off, said control means being responsive to said control signal to keep said fuel valve on only when said control signal indicates that a predetermined exhaust gas flow rate is exceeded; and (e) blower control means for connection to the blowe for starting and stopping operation of the blower.

11. The heating system as recited in claim 10 wherein said sensor means comprises conduit means for sensing and communicating exhaust gas pressure connected downstream from said flow restriction and said heating system further comprises means for introducing a flow of flushing gas into said conduit means to flush out exhaust gas.

* * * * *